US005404645A

United States Patent [19]

Janser

[11] Patent Number: 5,404,645

[45] Date of Patent: Apr. 11, 1995

[54] KNIFE BLADE HOLDER

[76] Inventor: Maximilian Janser, Boeblinger Strasse 91, D-7044 Ehningen, Germany

[21] Appl. No.: 54,942

[22] Filed: Apr. 29, 1993

Related U.S. Application Data

[63] Continuation of Ser. No. 676,940, Mar. 27, 1991, abandoned.

[30] Foreign Application Priority Data

Mar. 28, 1990 [DE] Germany ..... 40 09 905.9

[51] Int. Cl.[6] ..... B26B 5/00

[52] U.S. Cl. ..... 30/125; 30/162; 30/339

[58] Field of Search ..... 30/123, 162, 335, 339, 30/330, 331

[56] References Cited

U.S. PATENT DOCUMENTS

| | | | |
|---|---|---|---|
| 2,131,358 | 9/1938 | Rothschild | 30/125 |
| 2,187,590 | 1/1940 | Lurie | 30/330 X |
| 3,509,627 | 5/1970 | Gilbert et al. | 30/125 |
| 3,593,417 | 7/1971 | West | 30/125 |
| 3,927,473 | 12/1975 | Braginetz | 30/125 |
| 4,524,518 | 6/1985 | West | 30/330 |
| 4,922,610 | 5/1990 | Szabo | 30/125 |
| 4,939,839 | 7/1990 | Gorst | 30/125 |
| 5,005,290 | 4/1991 | Gilbert | 30/125 X |

FOREIGN PATENT DOCUMENTS

| | | |
|---|---|---|
| 1932139 | 11/1965 | Germany . |
| 3511091 | 10/1986 | Germany . |
| 3600318 | 7/1987 | Germany . |
| 1413679 | 11/1975 | United Kingdom . |
| 8807918 | 10/1988 | WIPO . |

*Primary Examiner*—Douglas D. Watts
*Attorney, Agent, or Firm*—Quarles & Brady

[57] ABSTRACT

The shaft parts of a laying knife are pivotable against one another in scissor-like manner with a joint for opening purposes and in the use position are prevented from rotating by a plug-in bolt constructed as a blade magazine and are prevented from spreading by front and rear locking devices, a rear knocking surface of the handle shaft being continuously formed by a single shaft part. This leads to very simple operation with high stability of the handle shaft.

54 Claims, 4 Drawing Sheets

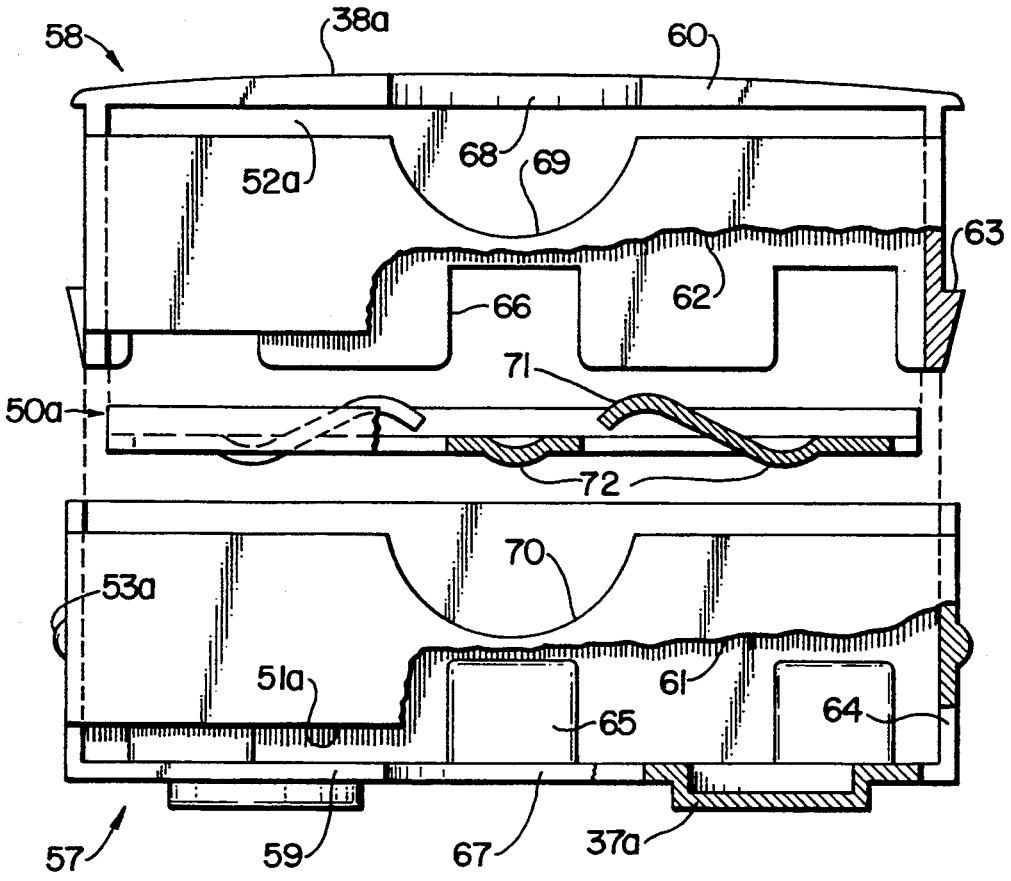
FIG. 8
FIG. 9
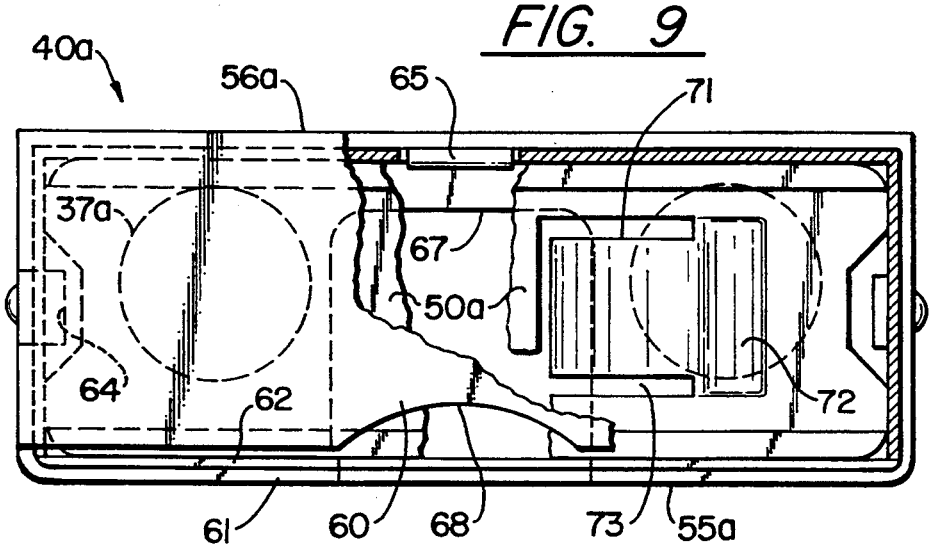

KNIFE BLADE HOLDER

BACKGROUND OF THE INVENTION

This is a continuation of application Ser. No. 07/676,940, filed Mar. 27, 1991, (now abandoned).

The invention relates to a holder for knife blades, such as are used for laying or carpet knives. Such knives have receptacle for plate-like or trapezoidal knife blades, which can form linear, crescent-shaped or similar cutting edges. For replacing the blade, a blade receptacle cover can undergo a position change after releasing a locking device, so that a parting plane is defined, which can be substantially parallel to the blade plane or can be located in a plate face of the inserted blade. According to the invention one or more locking means are provided and at least one locking means is insertable or removable substantially only through an approximately linear actuation.

German patent 36 00 318 discloses a laying knife in which the two shell parts of a shell grip or handle forming the holder are locked against one another by a clamp bolt. The latter is difficult to operate, it is complicated to manufacture and it is virtually impossible to define its tightening torque, so that it can easily become loose, and an actuating collar in the gripping area is always freely accessible.

SUMMARY OF THE INVENTION

An object of the invention is to provide a knife blade holder of the aforementioned type, which avoids the disadvantages of known constructions and which in particular ensures a simple and safe handling in the case of simple construction.

This object is achieved in that one or more locking devices are substantially formed by connections or joints such that for the operation thereof it is only necessary to have a rotary movement of less than four to five complete revolutions and in particular less than 360°, in order to transfer them between the release position freeing the blade receptacle and the locking position. The maximum necessary pivoting or rotating movement is appropriately less than 180° or 90° and can also be less than 30° or 15°.

It is also conceivable to operate at least one locking device exclusively in a linear manner and preferably provide it with a plug-in bolt, which can be inserted as a separate component into the assembled shell halves or the handle shaft parts, which define the blade receptacle. The plug-in bolt can be permanently mounted on a shaft part or can be completely removable for transfer into the release position of the two shaft parts. A rotary locking device can also be formed solely by plug-in bolts, so that only plug-in devices are provided.

It is particularly advantageous if at least one locking device acts only parallel to the junction plane, while at least one further locking device acts at least at right angles to the junction plane and optionally also parallel thereto, as well as in a direction at right angles to the longitudinal direction of the handle shaft. It is particularly advantageous if a follow-up locking device is e.g. provided in such a way that initially the bolt members to be rotated or joined approximately parallel to the junction plane are engaged and then with a further bolt member to optionally be inserted at right angles to the junction plane the opposite release movement is blocked.

It is particularly advantageous if the shaft parts can be moved against one another from the use position after releasing a corresponding securing means, at right angles to the shaft longitudinal direction, because in opposing manner they can then be particularly reliably and simply reassembled. Instead of this, or in addition thereto, the two shaft parts can be oppositely pivotable about a joint axis parallel or at right angles to the shaft longitudinal direction, and which is preferably roughly at right angles to the junction plane and/or spaced from the rear shaft end, the spacing being larger than the shaft width or thickness.

This joint axis, in which the shaft parts are detachably or non-detachably interconnected, forms a type of scissor joint at a distance behind the blade receptacle, which does not have to be released or loosened for the opening thereof, so that the two shaft parts are always undetachably interconnected. Simultaneously, the joint axis can form the rotation axis of one or more rotary locking devices, which are located in the shaft longitudinal direction on either side of the joint axis. In the case of a displaceable construction retightenable in the vicinity of the joint axis, the shaft parts can also be completely separated from one another.

Appropriately, the two shaft parts are secured against one another, at least at right angles to the blade plane, directly behind and/or in the vicinity of the longitudinal portion in which the blade receptacle is located or upstream of a connecting bolt, e.g. by direct reciprocal engagement and securing or locking devices can be provided on either side of a median longitudinal plane of the handle shaft or roughly in the vicinity of the blade back edge and/or the cutting edge or in the extensions thereof. Thus, the shaft parts are particularly well secured against spreading in the most highly stressed area.

Handle shafts or at least one shell part are preferably made from aluminium pressure die castings or a material with a similar, relatively soft characteristic spectrum, so that it is advantageous to provide for the most highly stressed area of the engagement of the blade rear edge, a reinforcement, which is formed by a separate, inserted component, e.g. of steel sheeting. This component need merely be in strip-like form and engage on one part of the length of the back edge.

The handle shaft also advantageously forms at least one pressing or knocking surface, which is suitable for pressing, flattening or knocking the carpet material or the like and which can be formed by the rear, in side view convexly rounded, end face of the handle shaft. Appropriately, this surface is substantially free from separating lines or similar interruptions over its entire width and/or height, all the separating lines being forwardly displaceable with respect to said surface between the two shaft parts. Thus, this surface permits particularly careful working. For example, one shaft part can be made shorter and the knocking surface can be formed only by a single shaft part. The associated, set back end of the one shaft part can be secured by a locking device on its end face.

Instead of or in addition to the described construction, the holder or handle shaft is appropriately constructed in such a way that it forms two directly succeeding handles or grips for an almost complete, simultaneous engaging round with two hands without the front hand extending over the front shaft end or into the vicinity of the blade. The shaft length is appropriately more than 19 or 20 cm, as a function of the longitudinal extension of a widened gripping knob provided on the rear shaft end. Through a continuous, in side view, approximately uniformly convexly curved, back surface of the handle shaft the front hand is advantageously only engaged by the inner surface for exerting pressure.

The invention also relates to a blade magazine, which serves to receive used blades with an insertion opening and/or for removing fresh blades with a removal opening and e.g. having two separate casing areas for the two blade types and which are located parallel to one another. Thus, the blades can be stored in a completely countersunk and protected, bat still readily accessible manner. This blade magazine is appropriately formed by a one-piece component which is completely separable from the holder and which can e.g. be so inserted in the handle shaft that with at least one outer face it forms a continuous extension of the outside of the handle shaft or is accessible without relative movement between the shaft parts from the outside thereof. The receptacle for the magazine can also be constructed in such a way that it blocks the blade against movements from the removal or insertion opening, by covering the said opening.

A particularly advantageous further development of the invention comprises that the casing-like, closed magazine forms a plug-in bolt, which simultaneously engages in both shaft parts in a substantially clearance-free manner or with slight pretension in the sense of its locking, so that after unlocking, the magazine is automatically accessible.

BRIEF DESCRIPTION OF THE DRAWINGS

These and further features of the preferred developments of the invention can be gathered from the claims, detailed description and the drawings, and the individual features can, either singly or in the form of subcombinations, be realized in an embodiment of the invention and in other fields and represent advantageous, independently protectable constructions for which protection is hereby claimed. An embodiment of the invention is described in greater detail hereinafter relative to the drawings, wherein:

FIG. 8 Shows a magazine according to FIG. 7 in an exploded front view.

FIG. 9 Shows the magazine according to FIG. 8 in a part sectional plan view.

DETAILED DESCRIPTION OF THE PREFERRED EMBODIMENTS

Figure 1:
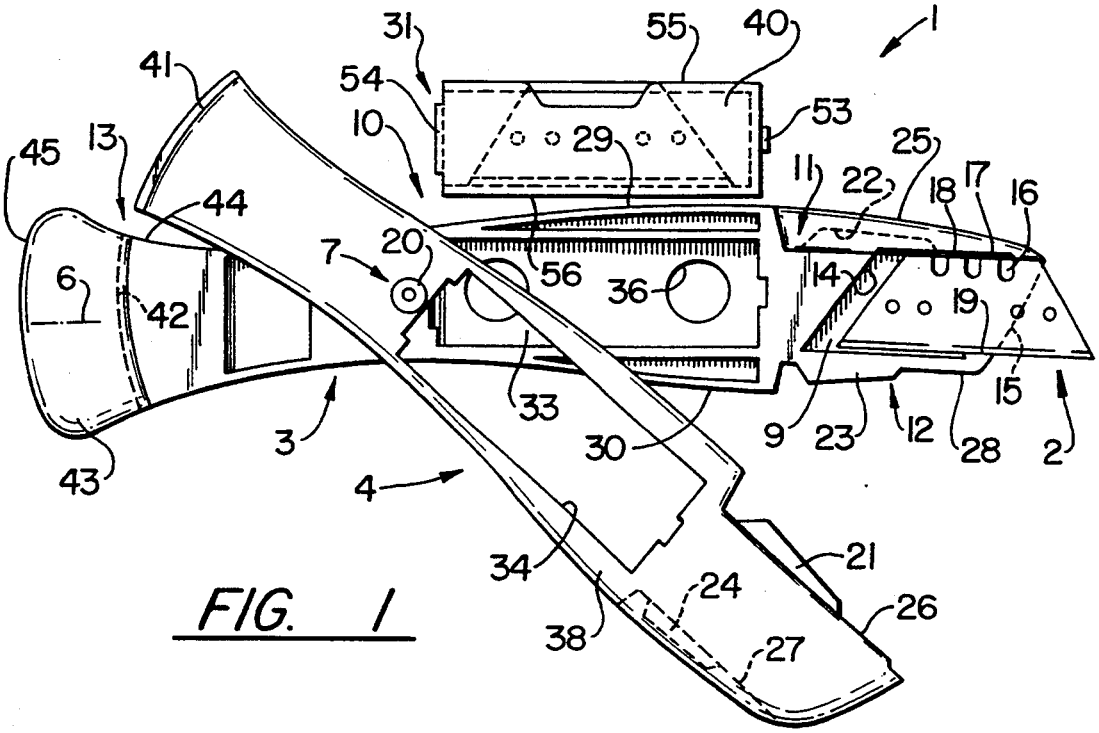
FIG. 1 Shows an inventive knife blade holder in the opened state and in side view.
Figure 2:
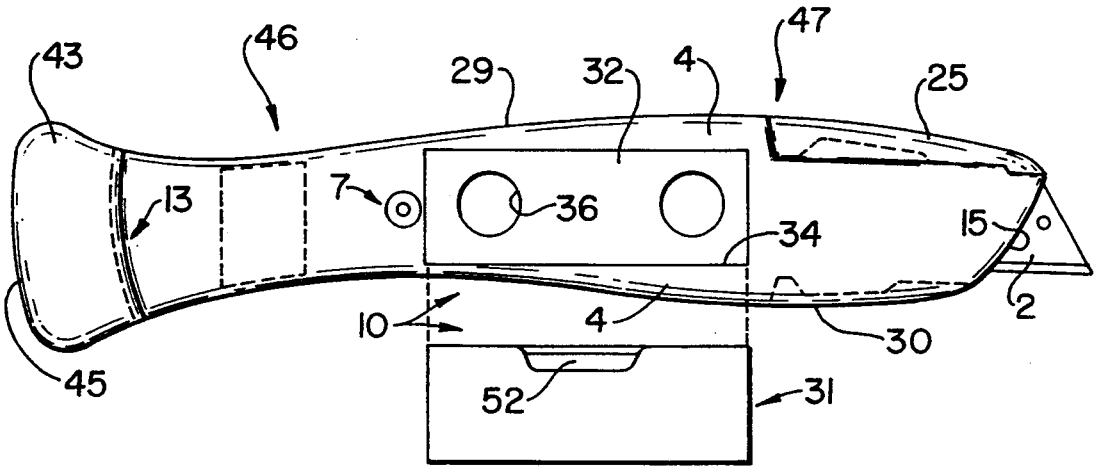
FIG. 2 Shows the holder according to FIG. 1 in the closed state.

Referring to the figures, the knife blade holder is used for fixing a blade 2 which, only on its longest base plate edge forms a cutting edge and is interchangeably positionable between the front ends of two shaft parts 3, 4. The blade 2 is inserted in longitudinally secured manner with a plate face in a junction plane 5, in a shaft part 3 and is then positively secured against movements at right angles to its plane by covering with the other shaft part 4. The shaft parts 3, 4 together form the outer faces of a handle shaft, whose longitudinal axis 6 passes through the center of its end faces and with respect to which the blade cutting edge is downwardly displaced and can be under an angle of a few degrees, which closes in the rearwards direction.

The two shaft parts 3, 4 can be pivoted with a joint 7 located behind the handle center and in front of the rear third of the shaft length about a joint axis 8 at right angles to the junction plane 5 by more than 90° and less than 180° with respect to one another and engage on one another in the use position in the vicinity of their front ends forming the blade receptacle 9 for the blade 2. Thus, the shaft parts 3, 4 are only pivotable against one another in one direction from the use position in which the arm of the shaft part 3 receiving the blade 2 in countersunk manner moves away in scissor-like manner from the other shaft part 4 in the direction in which points the back edge of the blade 2. Thus, on pivoting together the shaft parts 3, 4, the shaft part 4 reaches the blade 2 firstly at the cutting edge bounded by the inclined flanks, so that it can run with pretension onto the associated lateral flank of the blade 2.

At least in the use position, the two shaft parts 3, 4 are positively secured against one another by at least one locking or securing device 10 to 13. A rotary locking device 10 extends approximately up to the receptacle 9 or to the joint 7 and can also lock the shaft parts against longitudinal movements. Two spreading locking devices 11, 12 are located on either side either directly at a limited distance adjacent to the back or cutting edge side of the blade 2 between the locking device 10 and the front end face 15 of the two shaft parts 3, 4, as well as directly on either side of the junction plane 5. These locking devices 11, 12 also longitudinally secure another locking device 13. The latter device 13 is located behind the joint 7 and in front of the rear end face of the shaft part 3. It can be completely disengaged, but engages prior to the approximately simultaneous engagement of the locking devices 11, 12.

Between the locking devices 11, 12 in the inner face of the shaft part 3, a flat depression 14 is provided and adapted to the blade 2. The planar bottom of depression 14 adjacent to the end face 15 projects a single can 16 for engagement in several successive cutouts on the rear edge of the blade 2. Thus, the blade 2 can be inserted in such a way that its rear edge is located completely within the handle shaft or projects past the end face 15. A longitudinal boundary of the depression 14 forms a back stop 17 for the back edge of the blade 2 and the opposite longitudinal boundary forms a cutting edge stop 19.

The back stop 17 is formed by an inserted, web-like reinforcement 18, which can extend up to the front end face 15 or can be slightly set back.

If the reinforcement 18 is formed by an angle profile, then the inner face of its one leg located in the plane of the bottom of the depression 14 is depressed in the manner of a cavetto in the corner area in order to ensure a reliable lateral engagement of the blade 2. The stop 19 is connected to the end face 15 traversed in slot-like manner by the depression 14 and only extends over a small part of the length of the depression 14. The blade cutting edge, which is received in contact-free, protected manner behind the same.

The joint 7 is essentially formed by a joint belt 20 traversing one or both shaft parts and whose joint axis 8, above the longitudinal axis 6, is located roughly in the center of the associated shaft height or is eccentrically slightly below the same. The joint bolt 20 can be constructed in one piece with a shaft part, in the form of a separate linch pin and/or as a tension or clinch bolt, whose end is secured by riveting, screwing or the like with respect to the associated shaft part 3 or 4.

In the vicinity of the front end each shaft part 3 or 4 has a lateral projection 25 or 27 adjacent to the associated longitudinal edge and which transversely projects over the associated inner face, extends past the entire length of the receptacle 9 up to the front end face 15 and extends continuously from the associated longitudinal edge at the most up to the adjacent longitudinal boundary of the receptacle 9. With each projection 25 or 27 is associated on the other shaft part 4 or 3 a set back shoulder 26 or 28 in the form of an, in side view, angular recess of the associated longitudinal edge. In the use position, the projection 25, 27 fills the associated shoulder 26, 28 in such a way that the projection not only forms an extension of the associated longitudinal edge of the handle shaft, but also the part of the lateral face of the other shaft part 4 or 3 interrupted by the shoulder, or only the transition to said lateral face.

The oppositely projecting projections 25, 27 can be narrow in web-like manner. The projection 25 of the shaft part 3 is connected to its back face 29. The projection 27 of the shaft part 4 is connected to its facing longitudinal edge, which in the use position forms part of the underside 30 of the handle shaft. On the inner longitudinal side of the projection 25, facing the longitudinal axis 6 and roughly parallel to the latter and at right angles to the junction plane, a pocket-like plug-in opening 22 is provided for receiving a tongue or web-like plug-in member 26, which projects over the shoulder 26.

A lateral flank of the plug-in opening 22 or plug-in member 21, extending in the shaft longitudinal direction, is located in the junction plane or the associated inner face of the shaft part 4 or 3, while the other lateral flank can be slightly inclined in such a way that on inserting the plug-in members at right angles to the junction plane, the shaft parts can be exposed to a torque. The end flanks of the plug-in members are also inclined in a complementary manner, so that in the case of any joint clearance they can reciprocally and automatically orient one another.

At a limited distance, the base face of the plug-in opening 22 is roughly parallel to the associated portion of the shaft back 29. Correspondingly the shoulder 28 and the projection 27 connected to the underside 30 are provided with a single plug-in member 23 and a plug-in opening 24, which are located on the other side of the junction plane 5. The shoulder 28 is at a smaller distance from the stop 19. Both projections 25, 27 and/or both plug-in openings 22, 24 are of roughly equal length and/or extend over roughly the same longitudinal portion of the shaft.

In the use state, the plug-in members 21, 23 are completely countersunk between the upper and lower longitudinal edges 25, 30 and between the lateral faces of the shaft. They appropriately extend approximately to the rear end of the projections 25, 27 and a longitudinal spacing from the locking device 10 smaller than the length of the device 10. As a result of the described construction, the interengaging parts of the locking devices 11, 12 can also extend over a part of the longitudinal region of the handle shaft in which the blade 2 is located. The locking device 10 has a plug-in member 31, which is inserted from one lateral face of the handle shaft, extends in the longitudinal direction of the latter or is rectangular in a view of one or more sides, extending approximately over the entire height or width of the shaft and/or extending approximately up to the projections 25, 27 or the joint bolt 20.

Figure 4:
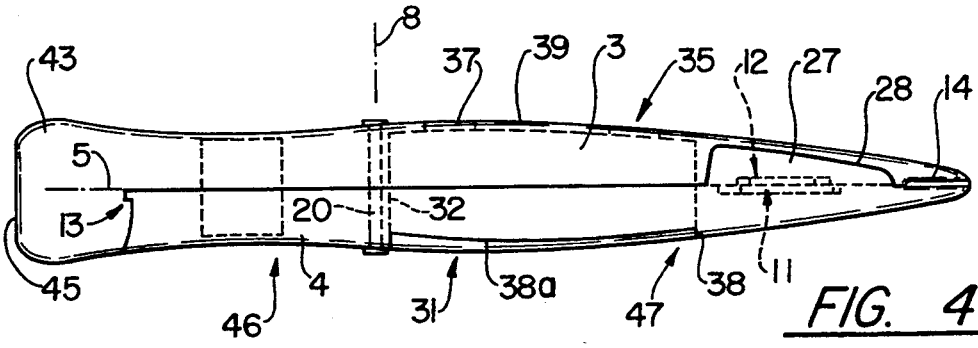
FIG. 4 Shows the holder according to FIG. 3 in a view from below, but without a knife blade.
Figure 3:
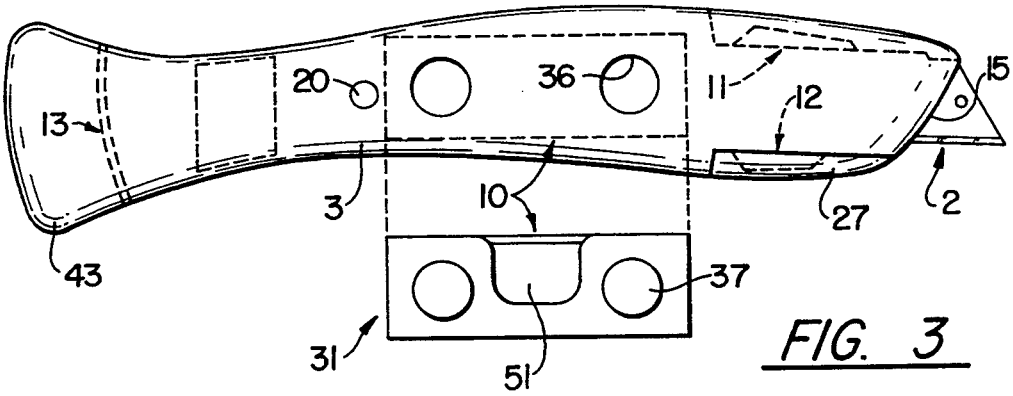
FIG. 3 Shows the holder according to FIG. 2 in a view of the other lateral face.

The plug-in member 31, which is only shown inserted in FIG. 4, can be inserted into a cup-shaped reception opening 32 bounded by the two shaft parts 3, 4 and which precisely corresponds to the associated outer contour thereof. For forming the reception opening 32, the inner face of the shaft part 3 has a cup-shaped, bounded reception pocket 33, whose wall-like, thin bottom forms with its outside the associated lateral face 39 of the handle shaft. However, in the shaft part 4 is provided a window-like opening 34 congruent with the reception pocket 33. The inserted plug-in member 31 forms a shear barrier against the opening of the handle shaft.

For securing the plug-in member 31 against dropping out is provided a locking means 35, e.g. a resilient latch or snap-in locking means in the form of locking openings 36 in the shaft part 3 and locking or latch pins 37 on the member 31 engaging in the same. Two successive locking openings 36 in the shaft longitudinal direction are in the form of breaks in the bottom wall of the reception pocket 33 and the plug-in member 31 has on its associated, planar outside the corresponding, projecting locking pins 37, which can have slightly widened end collars as snapping members.

The end faces of the locking pins 37 form continuous, flush extensions of the bulging lateral face 39 and adjacent to the two ends of the member 31 free pushbuttons as handles for unlocking and pressing out the member 31 of the reception opening 32. The remote, curved outer face of the plug-in member 31 forms a continuous and on all sides flush-connecting extension of the associated, bulging handle or side face 38.

The plug-in member 31 is preferably constructed as a casing or magazine 40, in which the blades 2 can be housed parallel to the junction plane 5, so that the blades are still accessible when the receptacle 9 is not opened or the shaft parts 3, 4 are not moved out of the use position. At least one stop cam engaging in an opening or a non-symmetrical shaping of the outer edges of the plug-in member 31 can be provided to ensure that the latter can only be inserted in a single longitudinal orientation.

Another locking device 13 extends over the entire associated shaft height and has as the plug-in member 41 an arcuate web, which projects onto the rear end of the shaft part 3, is located with a flank in the junction plane 5, is curved about the joint axis 8 and extends to the two longitudinal edges of the shaft part 4. The plug-in opening a correspondingly curved plug-in groove 42, which can be open at both ends. The groove 42 is provided in an arcuate shoulder of the shaft part 3 projecting past the junction plane, and is located forward of the widest region of a rear handle knob 43 and rearward of the most narrowed handle waist 44 of the handle shaft or in the transition region between the knob 43 and said waist. The arcuate web 41 can be extended out of at least one end of the plug-in groove 42. The shaft parts form a separating line at right angles to the blade plane which can extend with the particular one of the two ends up to the associated outer boundary of the handle shaft and expands over the entire associated extension of said shaft. Here instead of being directed longitudinally, the separating line is at or approximately at right angles to the shaft longitudinal direction and only extends over part of the shaft width.

Figure 5:
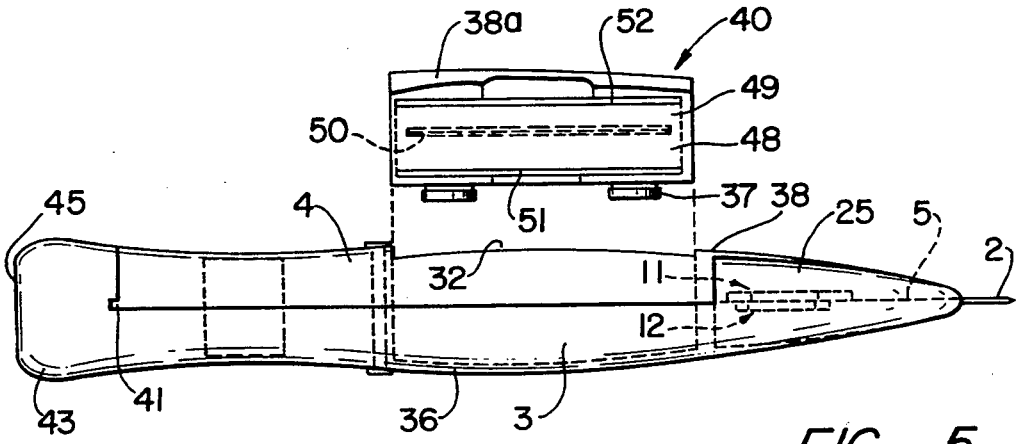
FIG. 5 Shows the holder according to FIG. 3 in plan view.

The rear end of the shaft part 4 consequently projects lass far over the joint axis 8 than the shaft part 3. The latter forms with its projecting end or knob 43 an, in side view, slightly curved and then a more strongly curved knocking surface 45 passing into the knob projections in the manner of a rounded hammer face. The one-piece knob 43 forms in side view the highest area of the handle shaft and in plan view according to FIG. 5 its widest area.

From the knob 43 the handle shaft is tapered forwardly both in side and plan view by concave outer boundaries and between the rear two quarters of its shaft length it has its narrowest area and then in both views widens forwardly again, so that roughly from the joint axis 8 or over the front two thirds of its length it has continuous convex or bulging lateral faces and longitudinal sides. The lateral faces 38, 39 pass approximately in an acute-angled manner towards the front end face 15 under an average angle of less than 30° or 20° in such a way that in the front area the holder can be made very narrow. The given arrangements, positions, dimensions, etc. apart from being precise in the manner described need only be approximate, substantial or diverging. In addition, the associated constructions can be provided individually or multiply.

The rear, through concave area of the underside of the handle shaft extends forwards further than the upper, continuous concave area, namely roughly up to half of the shaft length in such a way that the shaft over approximately its entire, forwardly connecting longitudinal portion has an approximately constant shaft height at right angles to the center axis. The handle shaft consequently forms a rear, narrower and forwardly slightly widened handle part 46, which passes continuously into a front handle part 47 widened in the shaft height and having continuously equidirectionally curved longitudinal edges. The rear handle part 46 is completely gripped around by one hand and to it can be directly connected the other hand also completely gripping round the front handle part 47.

The magazine 40 has a magazine chamber, which is subdivided into two juxtaposed chambers 48, 49 by an interposed spreading leaf spring 50 and whereof one is e.g. provided for superimposed, new knife blades. The new blade chamber 48 has a slot-like removal opening 51 on one longitudinal side of the magazine casing, while the other chamber 49 has a corresponding slot-like insertion opening 52 for inserting used blades into the chamber 49. The removal or insertion openings can be provided on the same or opposite casing sides. Appropriately the top or bottom wall of the magazine casing is provided in the vicinity of the removal opening with a finger cutout through which new blades can more easily be grasped. The chanbers 48, 49 change their size through the movable spring 50 forming a subdivision and a resilient fixing corresponding to the removal of new and the insertion of used blades. The spring presses the blades against the outer walls and prevents them from dropping out.

According to FIG. 1 on the longitudinal and/or narrow sides can be provided projecting, varyingly wide locking cans 53, 54 with which are associated in the associated walls of the opening 34 and the reception pocket 33 closely adapted recesses. The can 54 at joint 7 is wider than the facing cam 53, so that the magazine 40 can only be inserted in a predetermined longitudinal orientation. Its longitudinal outsides then form approximately plane-parallel blocking faces 55, 56 for the reciprocal blocking of the shaft parts 3, 4. Apart from the outside associated with the lateral face 38, appropriately all the remaining outer faces of the magazine 40 are substantially planar. The outside remote from the locking pins 37 has a convex configuration corresponding to the opposite lateral face 39 and as a partial gripping surface **38*a*** engages on the right-hand gripping or handle side, so that it rests on the inner face of the hand when the holder is used by a right-handed person.

Each of the described parts can be constructed in one piece with the casing of the magazine 40, so that the latter is only formed by a single, one-piece component. The magazine 40 can be in the form of an injection plastic molding, whose bottom and/or top wall is fixed by snap connections to a base body forming the magazine chambers. Appropriately the base body has the cams, while the bottom wall is constructed in one piece with the locking pins 37. In the use state, in the manner of an inserted handle shell, the top wall forms a part of the associated lateral gripping face.

The shaft parts 3, 4 can define at least one further chamber appropriately located behind the joint axis 8 and which is only accessible when the handle shaft is open.

In FIGS. 6 to 9 corresponding arrangements are given the seine references as in FIGS. 1 to 5, but followed by the letter a, so that the description parts apply to all embodiments and random arrangements or features of all the embodiments can be provided in random combination or addition in other embodiments.

Figure 6:
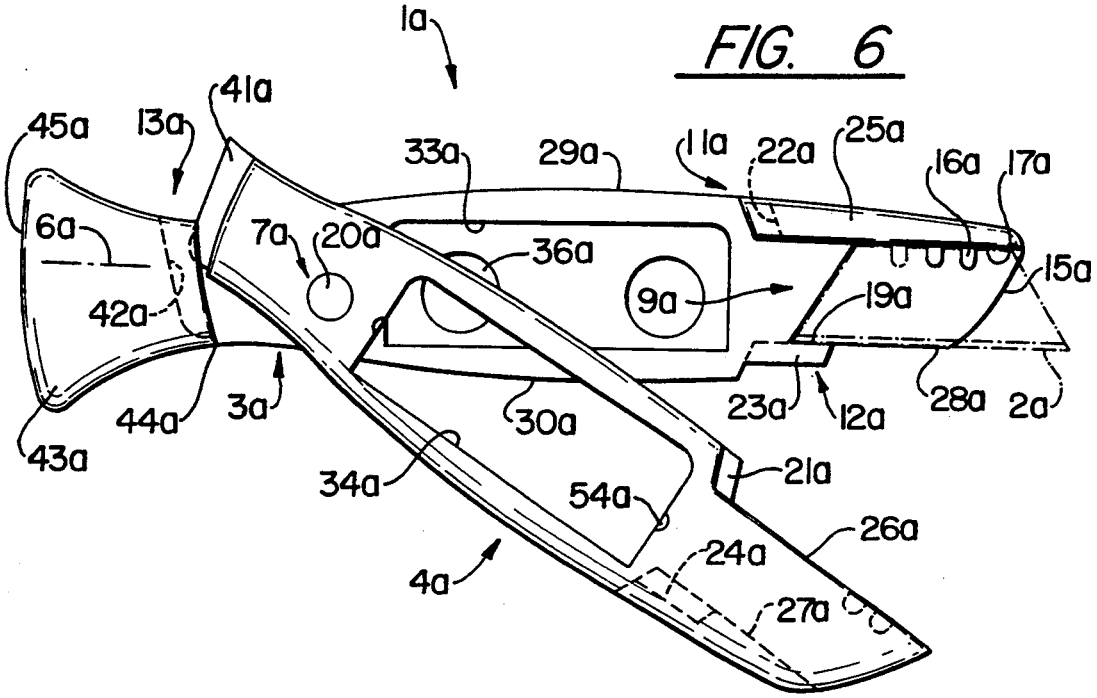
FIG. 6 Shows another embodiment in a representation corresponding to FIG. 1.
Figure 7:
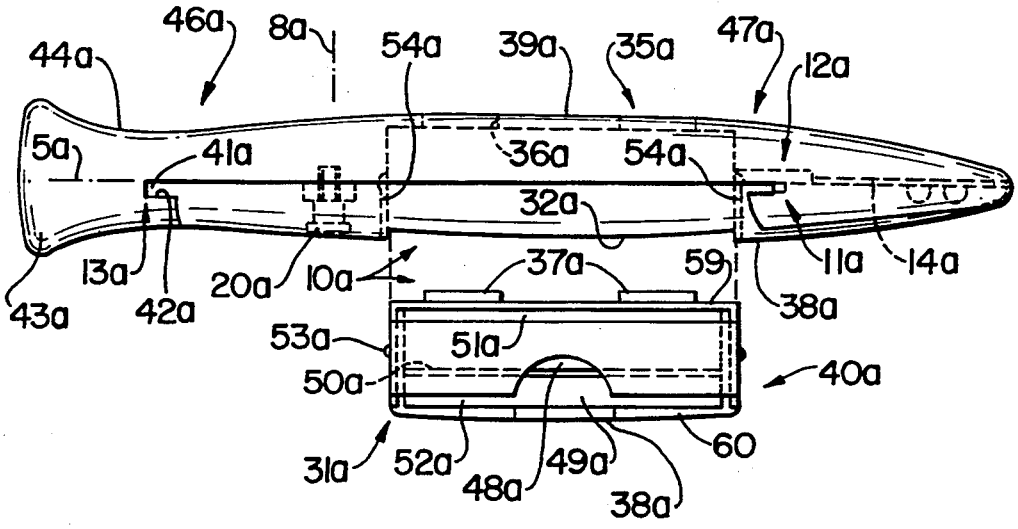
FIG. 7 Shows the embodiment according to FIG. 6 in the closed state and in plan view, including the locking member.

According to FIGS. 6 and 7 the blade receptacle **9*a* does not have any separate reinforcement and instead the support faces for the back and the cutting edge of the blade 2*a* are constructed in one piece with the shaft part 3*a* or the projection 25*a* and the plug-in member 23*a*, so that the back of the blade 2*a* can be supported directly on the aluminium, plastic or similar back stop 17*a* formed by the projection 25*a* and the cutting edge is only supported with the rear part of its longitudinal extension directly on the cutting edge stop 19*a*, which is formed by a front end portion of the plug-in member 23*a* and is also made from at least one of the aforementioned materials. The shoulder 28*a* connected at the front to the plug-in member 23*a* is here located in the vicinity of the blade cutting edge, so that in the side view according to FIG. 6 the shoulder 28*a* forms an oppositely directed, approximately planar, through extension of the stop 19*a*. With the holder 1*a* closed, the cutting edge stop is also formed by the inner shoulder of the projection 27*a*, which then essentially engages on the shoulder 28*a* or the cutting edge. Thus, it is possible to do away with the depression 14, because the cutting edge stop 19*a* can be entirely formed by the other shaft part 4*a* or its projection 27*a***.

For position securing purposes, two successive cans **16*a* are provided extending from the back stop 17*a* and on the inner face of the shaft part 3*a*. A corresponding, pocket-shaped reception depression on the inner face of the other shaft part 4*a*, does not pass through to its outer or side face receives the cam 16*a* on closing the shaft parts 3*a*, 4*a*, so that this further secures against longitudinal movements of the two shaft parts 3*a*, 4*a* in their furthest forward region forward of the locking devices 11a, 12a and directly rearward of the end face 15a. Also in the case of a possible spreading of the two shaft parts 3a, 4a in the furthest forward region, the blade 2a can consequently not be released from its positive locking with respect to the holder 1a. The reception recesses are connected in groove]like manner directly to the shoulder 26a**.

The plug-in opening 22a of the locking device 11a is in this case formed by a through groove between the rear extension of the back stop 17a and the shaft back 29a, which is inclined slightly rearwards with respect to the shaft back 29a and which, with the holder 1a closed, is filled by the plug-in member 21a, at least in the vicinity of the shaft back 29a. The plug-in member 21a is connected to the rear end of the shoulder 26a, namely on a transverse shoulder extending from the shoulder 26a and extending up to the shaft back 29a and to which also extends the plug-in member 21a, so that with the holder 1a closed it forms part of the shaft back.

Correspondingly the plug-in member 23a is connected to a rear transverse shoulder of the shoulder 28a and said transverse shoulder passes through to the underside 30a of the holder 1a. However, the plug-in member 23a is set back with respect thereto, so that although the pocket-like plug-in opening 24a can pass through to the rear end of the projection 27a, its bottom surface is set back with respect to the underside 30a. As a result of the described construction the back stop 17a and the shoulder 26a, in side view, can in each case pass substantially linearly from the rear end to the front end. In the vicinity of the back stop 17a the shaft back 29a here solely formed by the shaft part 3a is, in side view, appropriately located roughly parallel to the back stop 17a and only in the furthest forward region is it rounded for passing into the end face 15a, which leads to a high support stability against the cutting forces which occur.

The plug-in member 41a and plug-in opening 42a of the locking device 13a appropriately do not extend to the underside 30a and are instead set back by a few millimeters with respect thereto, so that behind the rear end of the shaft part 4a having the projecting plug-in member 41a, the underside 30a is only formed by the shaft part 3a. The entire surface of the rear end of the shaft part 4a engages on a transverse shoulder of the shaft part 3a traversed by the plug-in opening 42a adjacent to the outer lateral flank of the plug-in member 41a. Since in the case of a closing pivoting movement, the rear end of the shaft part 4a can strike with the associated end of the plug-in member 41a on the pocket-shaped end of the plug-in opening 42a, said rear end is very well secured against loading. Apart from increased stability, the described constructions of the locking devices and blade receptacle further simplify manufacture.

The joint 7a appropriately has a screw bolt 20a located in the joint axis 8a and inserted from the lateral face of the shorter shaft part 4a and which engages with a threaded portion in a part projecting past the inner face of the shaft part 3a and which engages in the manner of a pivot in a depression on the inner face of the shaft part 4a. The joint bolt 20a appropriately engages in pretensioned manner with a ring shoulder formed by a thread-free bolt portion on the end face of the projecting part and slides with a further ring shoulder, e.g. formed by a bolt head on a corresponding countershoulder of the shaft part 4a, so that as a result, the axial clearance between the two shaft parts 3a, 4a can be precisely predetermined, while the projecting part engaging in the depression can also absorb high radial forces, more particularly directed at right angles to the longitudinal direction of the holder 1a. The head of the joint bolt 20a is completely sunk in the lateral face of the shaft part 4a and its threaded portion engages in a blind hole threaded bore of the shaft part 3a, so that it does not extend up to the opposite lateral face 39a. The magazine 40a provided as a plug-in member 31a has a casing adapted in its rectangular internal cross-section to the blade shape to such an extent that the length of said cross-section corresponds to the length of the cutting edge and the width of said cross-section corresponds to the spacing between the cutting edge and the blade back. The casing comprises two substantially rectangularly bounded, cup-shaped casing parts 57, 58, which in each case have four circumferential walls extending over the entire casing height and which are at an angle to one another, so that in the assembled state has a substantially double-walled construction in the vicinity of one to all the circumferential walls, except at the bottom and top wall. Except for the front wall the remaining three circumferential walls of the inner casing part 58 strike with their terminal edges in the vicinity of the associated cup-shaped opening on the inner face of the bottom 59 of the outer casing part 57. Correspondingly, apart from the front wall located on one casing longitudinal side, the three remaining circumferential walls of the casing part 57 strike with their longitudinal edges in a common plane in the vicinity of the associated opening on a U-shaped shoulder .face of the casing part 58, which is approximately in the plane of the inside of the associated bottom or top wall 60 and in the manner of a web for said top wall projects over the outsides of the three circumferential walls of the casing part 58 by the wall thickness of the walls of casing part 57. Thus, apart from in the vicinity of the top wall 60, the casing part 57 forms substantially all the outer faces of the casing.

On the narrow sides at right angles to the openings 51a, 52a, the two casing parts 57, 58 are positionally locked against one another by means of at least one snap-action connection, which automatically engages on assembly. Following onto their longitudinal edges at the cup-shaped opening, on the outsides of each associated circumferential wall of the casing part 58 is provided a barb-like projecting snap-action can 63 with a bolt surface directed towards the shoulder of the top wall 60 and with which is associated in the associated circumferential wall of the casing part 57 a snap-action opening 64, which extends in angular manner into the bottom 59. The cam 63 is resiliently movable due to the back-springing characteristics of the associated circumferential wall and is easily accessible from its outside for unlocking or opening the casing. With the casing closed the outsides of one to all the circumferential walls of the casing part 58 engage on the insides of the associated circumferential walls of the casing part 57.

The longitudinal edge of the front wall 62 of the casing part 58 on one longitudinal side of the casing at the associated cup-shaped opening is set back with respect to the associated longitudinal edges of the three remaining circumferential walls by roughly the same amount as the longitudinal edge of the corresponding front wall 61 of the casing part 57 located closer to the bottom 59 is set back with respect to the inside of the bottom wall 59. Therefore these two longitudinal edges of the front wall 61, 62 fore a linear longitudinal boundary of the slot-shaped removal opening 51*a* extending over the entire casing length and whose facing boundary is formed by the inside of the bottom 59. Correspondingly the two other longitudinal boundaries of the front wall 61, 62, namely the longitudinal boundary of the front wall 61 at the associated cup-shaped opening and which is set back and the longitudinal boundary of the front wall 62 spacedly facing the inside of the top wall 60 jointly form a longitudinal boundary of the insertion opening 52*a*, whose other longitudinal boundary is formed by the inside of the top wall 60. In the bottom wall 59 is provided at least one opening or cutout 67 extending over most of the casing depth and which is connected to the leading edge of the bottom wall 59 located at the removal opening 51*a* and is appropriately located in its center or between the pins 37*a*. By inserting a finger in this cutout 67 the underside of the bottom blade can be grasped and shoved out forwards through the removal opening 51*a*. Appropriately on the inside of the facing rear wall cams projecting into the casing are provided and form guide bevels, which approach under a few radians from the inside of the rear wall of the casing to the casing bottom 59 of the removal opening 51*a*. Thus, the in each case bottom blade is so necessarily slightly displaced in the direction of the removal opening 51*a* compared with the blades above it that it engages between the longitudinal boundaries of the removal opening. These cans are appropriately provided on the inside of the rear wall of the outer casing part 57 and pass through cutouts 66 in the rear wall of the inner casing parts 58.

In the vicinity of the insertion opening 52*a* both in the top wall 60 constructed in one piece with the casing part 58 and in the front wall 62 is provided at least one pitch circular, concave cutout 68, 69 extending up to the associated boundary edge located at the insertion opening 52*a*, the two cutouts 68, 69 located roughly in the center of the casing length appropriately jointly forming a finger opening, which in cross-section extends through the casing into the front wall and top wall. The front wall 61 of the outer casing part 57 has a cutout 70 roughly congruent with the cutout 69.

The two pins 37*a* are provided on the outer casing part 57 and project in cup-shaped manner roughly by the wall thickness of the bottom 59 over the outside thereof. They are slightly transversely displaced with respect to the median longitudinal plane of the magazine 40, which prevents an inverted insertion of the magazine 40 in its two positions rotated about its tranverse axis. In addition, in the plan view of FIG. 9, the outer narrow sides of the casing pass in acute-angled manner into the outside of the casing rear wall or barrier surface 56*a*, while they pass in rounded form into the casing front wall or barrier surface 55*a*, so that this also prevents any inverted insertion of the magazine 40*a* into the reception opening 32*a*. The bottom of the reception opening 32*a* is substantially planar corresponding to the outside of the bottom 59 of the magazine 40*a* and in this area the lateral face 39*a* of the shaft part 3*a* is substantially planar, so that a bottom wall with an approximately constant wall thickness is obtained for the reception opening 32*a*. Thus, the end faces of the pins 37*a* can also be planar and be located in the plane of the lateral face 39*a*. On each narrow side of the casing and displaced with respect to the associated snap-action connection 63, 64 to the top wall 60 and roughly in the center of the casing height is provided a locking cam 53 in the form of a spherical segmental projection on the outside of the casing part 57 and with which is associated a locking opening 54*a* in the associated lateral face of the reception opening 32*a*. The locking opening 54*a* is appropriately roughly symmetrical to the separating plane 5*a*, so that when the holder 1*a* is closed it is formed by the two shaft parts 3*a*, 4*a*. In the corresponding lateral faces of the reception opening 32*a* or the opening 34*a* can be provided sliding grooves extending up to the insertion opening and used for the locking can 53*a* and which are in each case connected to one of the locking openings 54*a* and have a smaller depth than the latter, so that the locking can 53*a* can slide therein only with increased friction until it resiliently springs into the locking opening 54*a* or is released at the outside of the lateral face 38*a*. As a result of the locking cams 53*a*, the pins 37*a* can have constant circumferential surfaces over their height, because they no longer need to have any locking function. As a result of the shaft parts, the plug-in member is shear-stressed at the blocking surfaces.

For loose insertion in the casing, particularly casing part 58, there is a one-piece intermediate bottom 50*a*, which is only guided by sliding of its longitudinal edges on the inner faces of the circumferential walls of the casing part 58. This intermediate bottom has on its side facing the top wall 60 two longitudinal webs projecting along its longitudinal edges and via which two longitudinally oppositely directed, tongue-like, freely projecting springs 71 project with can-like curved end portions. These springs 71 are located between the longitudinal webs and are shaped in one piece from the base plate. Thus, the springs 72 can be resiliently pressed into the cutouts of the base plate and with their can-like protuberances can either be supported on the inside of the top wall 60 or on the flat sides of used blades, which are inserted via insertion opening 52*a*.

On the outside remote from said protuberances, the base plate has at least two or three longitudinally, successively spaced, cross-sectionally curved cans 72*a*, which in web-like manner are at right angles to the longitudinal direction of the intermediate bottom 50*a* and can be supported on the blades to be drawn out through the removal opening 51*a* or on the inside of the bottom 59. Two cans 72 are located with a limited spacing adjacent to the ends of the intermediate bottom 50*a* or in the vicinity of the roots of the springs 71, while a further can 72 is interposed roughly in the center. On their terminal edges the substantially planar base plate of the intermediate bottom 50*a* has cutouts, so that it does not impede any unlocking of the snap-action connections. Thus, the magazine 40*a* can be opened at any time for replacing the blades, i.e. reused.

I claim:

1. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in operating position, wherein said locking means includes at least one plug member releasably insertable into a plug opening in said handle from the outside of said holder, means being provided positionally holding said at least one plug member in operating position, said holding means engaging by exclusively inserting said at least one plug member into said plug opening, said plug member being positionally secured in all orientations of said blade holder, said at least one plug member being entirely separable from at least one of said handle to permit opening of said handle, said handle having a length longer than its width, said plug member being oblong and having a length that is substantially parallel to the handle length when inserted in the handle.

2. The holder according to claim 1, wherein said at least one plug member is entirely disconnectable from said handle members.

3. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in an operating position, wherein said locking means includes at least one plug member releasably insertable into a plug opening in said handle from the outside of said holder, means being provided for positionally holding said at least one plug member in said operating position, said holding means engaging exclusively by inserting said at least one plug member into said plug opening, said at least one plug member being entirely separable from at least one of said handle members to permit opening of said handle, wherein said holding means provides at least one securing member in one part with at least one of:

said plug member; and said handle, said holding means securing against withdrawal in a releasable manner, wherein said plug member connects to said handle in a plug inserting direction, said holding means including a snap member on a side of the plug member substantially parallel to said plug inserting direction, said plug opening providing a counter member for engaging said snap member.

4. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in an operating position, wherein said locking means includes at least one plug member releasably insertable into a plug opening in said handle from the outside of said holder, means being provided for positionally holding said at least one plug member in said operating position, said holding means engaging exclusively by inserting said at least one plug member into said plug opening, said at least one plug member being entirely separable from at least one of said handle members to permit opening of said handle, wherein said at least one plug member includes a magazine for receiving at least one blade.

5. The holder according to claim 1, wherein said handle members define an intermediate plane of separation and the blade defines a blade plane when in a cutting position, a receptacle being provided for receiving the blade when in said cutting position, said handle members being reciprocally displaceable substantially parallel to at least one of said separation and said blade plane in the vicinity of said receptacle, thereby providing means for replacing the blade.

6. The holder according to claim 1, wherein said handle defines, between remote longitudinal ridges, varying overall handle height extensions and overall handle width extensions, bounded by said longitudinal ridges, said handle members being displaceable in a plane transverse to said overall handle width extensions, said handle providing a rear handle portion dimensioned to be circumferentially gripped by a single user hand and a frontal handle portion frontally connecting to said rear handle portion and providing a ball pressure face for a second hand of the user, wherein said rear handle portion traverses into said frontal handle portion by a steady increase of said overall handle width extensions, both said longitudinal ridges being equidirectionally curved substantially over said frontal handle portion.

7. The holder according to claim 1, wherein said plug member includes a magazine for knife blades constructed to be entirely separably fixed to a gripping portion of the handle, said magazine comprising at least one receptacle for at least one of the knife blades and defining outside, said magazine having at least one connecting element for fixedly engaging said handle, wherein means are provided for entirely countersinking said magazine into said gripping position.

8. The holder according to claim 1, wherein said at least one plug member is releasable and entirely separable from said handle only by a linear retracting motion from said operating position.

9. The holder according to claim 5, wherein at least two of said plurality of handle members have front ends and rear ends and provide inner faces in the vicinity of at least one of said separation plane and said blade plane, said handle member defining a central longitudinal portion between said front ends and said rear ends, said handle members having at least one of areas defined by:

said central longitudinal portion;

an area extending around a joint axis, said handle members reciprocally pivoting around said joint axis;

an area of at least one locking device of said locking means located in the vicinity of said front ends; and an area of at least one locking device of said locking means located in the vicinity of said rear ends; in at least one of said areas, at least one of said inner faces being located substantially in a single plane.

10. The holder according to claim 5, wherein said handle members are reciprocally pivotable, in a scissor-like manner about a joint axis substantially at right angles to said separation plane, between said operating position and an opened position exposing said receptacle.

11. The holder according to claim 1, wherein said handle has a front end and a rear end along an overall longitudinal extension of said handle, said handle members being reciprocally pivotable about a joint axis located at distance between said front end and said rear end, said longitudinal extension having an extension center, said joint axis being located between said extension center and said rear end, said at least one plug member being located behind said blade in said operating position.

12. The holder according to claim 1, wherein a reception opening is provided in said handle for said at least one plug member, said handle defining an overall height extension and a height center of said height extension, said handle members being reciprocally pivotable about a joint axis located closely behind said reception opening and substantially in said height center.

13. The holder according to claim 5, wherein one of said handle members provides a locking projection for locking insertion in a locking opening on the other handle member.

14. The holder according to claim 3, wherein said plug member includes a magazine for knife blades constructed to be entirely separably fixed to a gripping portion of the handle, said magazine comprising at least one receptacle for at least one of the knife blades and defining outside, said magazine having at least one connecting element for fixedly engaging said handle, wherein means are provided for entirely countersinking said magazine into said gripping position.

15. The holder according to claim 5, wherein at least one of said at least one locking means has a plugging tongue defining a plug engaging depth extension oriented in a plug insertion direction and a plug width extension oriented transverse to said insertion direction, at least one of said at least one locking device having a plug receiving pocket closely adapted to said plugging tongue, said width extension being greater than said depth extension.

16. The holder according to claim 5, wherein one of said handle members has a shoulder-like stop face traversing and projecting laterally past said separation plane towards the other of said handle members, said handle defining an outer contour, said stop face being inwardly spaced with respect to said outer contour, said locking means including locking structure located in the vicinity of said stop face.

17. The holder according to claim 16, wherein said handle has a front area including said receptacle for receiving the at least one blade in said cutting position, said stop face being located in said front shaft area.

18. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in an operating position, wherein said locking means includes at least one plug member releasably insertable into a plug opening in said handle from the outside of said holder, means being provided for positionally holding said at least one plug member in said operating position, said holding means engaging exclusively by inserting said at least one plug member into said plug opening, said at least one plug member being entirely separable from at least one of said handle members to permit opening of said handle, wherein said handle members define an intermediate plane of separation and the blade defines a blade plane when in a cutting position, a receptacle being provided for receiving the blade when in said cutting position, said handle members being reciprocally displaceable substantially parallel to at least one of said separation and said blade plane in the vicinity of said receptacle, thereby providing means for replacing the blade, wherein at least two of said plurality of separate handle members displace relative to each other about a joint axis, said at least two of said plurality of separate handle members defining:

an area spaced from said locking means;

an area spaced from said joint axis;

an area in front of said joint axis toward said receptacle; and an area behind said joint axis away from said receptacle; said locking means securing said at least two of said plurality of handle members relative to each other by connecting to said at least two of said plurality of handle members in a direction transverse to at least one of:

said separation plane; and said blade plane, further comprising a locking web curved around said joint axis on one of said handle members and a groove formed on the other handle member for matingly engaging and exposing said web upon opening said handle.

19. The holder according to claim 18, wherein said handle has a longitudinal rear end, said groove being located between said rear end and said joint axis, said groove having at least one open groove end, said web being entirely removable from said at least one groove end.

20. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in an operating position, wherein said locking means includes at least one plug member releasably insertable into a plug opening in said handle from the outside of said holder, means being provided for positionally holding said at least one plug member in said operating position, said holding means engaging exclusively by inserting said at least one plug member into said plug opening, said at least one plug member being entirely separable from at least one of said handle members to permit opening of said handle, wherein said handle members define an .intermediate plane of separation and the blade defines a blade plane when in a cutting position, a receptacle being provided for receiving the blade when in said cutting position, said handle members being reciprocally displaceable substantially parallel to at least one of said separation and said blade plane in the vicinity of said receptacle, thereby providing means for replacing the blade, wherein at least two of said plurality of separate handle members displace relative to each other about a joint axis, said at least two of said plurality of separate handle members defining:

an area spaced from said locking means;

an area spaced from said joint axis;

an area in front of said joint axis toward said receptacle; and an area behind said joint axis away from said receptacle; said locking means securing said at least two of said plurality of handle members relative to each other by connecting to said at least two of said plurality of handle members in a direction transverse to at least one of:

said separation plane; and said blade plane, wherein said locking means provides at least two locking devices on either side of at least one of said separation plane and said blade plane separate from said plug member and a joint defining said joining axis.

21. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in an operating position, wherein said locking means includes at least one plug member releasably insertable into a plug opening in said handle from the outside of said holder, means being provided for positionally holding said at least one plug member in said operating position, said holding means engaging exclusively by inserting said at least one plug member into said plug opening, said at least one plug member being entirely separable from at least one of said handle members to permit opening of said handle, wherein said handle has a longitudinal rear end, said rear end having a widened portion defining a rear end face of said handle, said end face providing a knob head face exclusively formed by a single one of said handle members in a closed, operating position.

22. The holder according to claim 9, wherein one of said handle members has a shallow depression for said receptacle, said depression being located between at least two locking devices of said locking means in side view of the handle.

23. The holder according to claim 9, wherein one of said handle members has a shallow depression for said receptacle, said depression being located forward of at least two of said locking devices of said locking means.

24. The holder according to claim 5, wherein the at least one blade has edges including a cutting edge and a back edge opposite the cutting edge, said receptacle being substantially provided by a depression bounded by at least one reinforced bearing edge for bearingly engaging at least one of said edges, said at least one bearing edge being formed in one piece with at least one of said handle members and extending laterally, at the most, up to said separation plane.

25. The holder according to claim 6, wherein said handle has an overall longitudinal extension, a length center of said longitudinal extension and a front end, said longitudinal ridges passing continuously and smoothly over said rear handle portion and said frontal handle portion, said longitudinal ridges being substantially uniformly convexly curved substantially between said length center and said front end.

26. The holder according to claim 1, wherein said handle members separate about a joint axis and further including a receptacle formed by to at least one of said handles for holding a blade, said plug member substantially extends between said joint axis and said receptacle.

27. The holder according to claim 1, wherein said handle has two lateral faces, said plug member forming a continuous oblong extension of at least one of said two lateral faces in its inserted position.

28. The holder according to claim 1, wherein said plug member connects to said handle in a plug inserting direction and has a substantially elongated rectangular shape when viewed in said plug inserting direction.

29. A knife blade holder for holding at least one blade comprising:

a partially hollow handle subdivided into a plurality of separate handle members displaceable relative to each other for opening said handle; and locking means for releasably locking said handle members in an operating position, wherein said locking means includes at least one plug member releasably insertable into a plug opening in said handle, and separable from at least one of said handle members to permit opening of said handle wherein said plug opening is formed by a window-shaped opening in one of said handle members and a plug reception pocket substantially congruent with said window-shaped opening in the other handle member, said reception pocket having a base wall forming a lateral face of said other handle member.

30. The holder according to claim 29, wherein said handle defines a longitudinal direction and said plug member is elongated in said longitudinal direction.

31. The holder according to claim 1, wherein said holding means provides at least one securing member in one part with at least one of:

said plug member; and said handle, said holding means securing against withdrawal in a releasable manner, said holding means releasably securing said plug member against withdrawal and separation of said plug member from said handle members; when released, said plug member being separable from at least one of said handle members, said holding means providing resilient snap members.

32. A knife blade holder for holding at least one blade comprising:

a partially hollow handle subdivided into a plurality of separate handle members displaceable relative to each other for opening said handle; and locking means for releasably locking said handle members in an operating position, wherein said locking means includes at least one plug member releasably insertable into a plug opening in said handle, and separable from at least one of said handle members to permit opening of said handle, wherein said handle provides an externally accessible outside, said plug opening having a bottom wall with at least one pin opening, said plug member being provided with at least one pin engaging in said at least one pin opening when in a locking position, said at least one pin providing a pushbutton on said accessible outside for ejecting said plug member.

33. The holder according to claim 32, wherein said plug member includes a magazine for knife blades constructed to be entirely separably fixed to a gripping portion of the handle, said magazine comprising at least one receptacle for at least one of the knife blades and defining outside, said magazine having at least one connecting element for fixedly engaging said handle, wherein means are provided for entirely countersinking said magazine into said gripping position. transverse to a longitudinal extension having a front end face and a rear end face, said locking means including locking structure spaced from the rear end face and extending substantially entirely along said shaft height extension.

34. A knife blade holder for holding at least one blade comprising:

a handle subdivided into a plurality of separate handle members reciprocally displaceable for opening said handle, said handle having a gripping portion for circumferentially gripping said blade holder for cutting operation;

locking means for locking handle members in an operating position; and a casing for receiving auxiliary working material, said casing being provided in one of said handle members and in said gripping portion, said casing being operationally entirely separable from said one of said handle members, said handle having a rear end, wherein said casing is spaced from said rear end, said casing being laterally displaceable to be separated from at least one of said handle members.

35. The holder according to claim 34, wherein said handle defines an accessible outside, said casing being accessible from said outside and entirely removable from said handle.

36. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in operating position, wherein said locking means includes at least one plug member releasably insertable into a plug opening in said handle from the outside of said holder, means being provided positionally holding said at least one plug member in operating position, said holding means engaging by exclusively inserting said at least one plug member into said plug opening, said at least one plug member being entirely separable from at least one of said handle to permit opening of said handle, wherein said plug member provides a casing having at least one slot-like opening providing a removable opening and an insertion opening for removing and inserting at least one blade with respect to the casing.

37. The holder according to claim 36, wherein, when said plug member is inserted in said handle, said at least one slot-like opening is closed by being covered by at least one of said handle members.

38. A knife blade holder for holding at least one blade comprising:

a partially hollow handle subdivided into a plurality of separate handle members displaceable relative to each other for opening said handle, an exterior surface of said handle members defining an outside of said holder; and locking means for releasably locking said handle members in operating position, wherein said locking means includes at least one plug member releasably insertable into a plug opening in said handle from the outside of said holder, means being provided positionally holding said at least one plug member in operating position, said holding means engaging by exclusively inserting said at least one plug member into said plug opening, said at least one plug member being entirely separable from at least one of said handle to permit opening of said handle, wherein said handle members define an intermediate plane of separation and the blade defines a blade plane when in a cutting position, a receptacle being provided for receiving the blade when in said cutting position, said handle members being reciprocally displaceable substantially parallel to at least one of said separation and said blade plane in the vicinity of said receptacle, thereby providing means for replacing the blade, wherein said plug member is constructed for receiving a plurality of blades in an orientation parallel to at least one of said separation plane and said blade plane.

39. The magazine according to claim 7, wherein means are provided for modifying a positioning of the knife blades between a position mounted on the magazine and a position free of said magazine.

40. A magazine for knife blades constructed to be entirely separably fixed to a gripping portion of a handle, said magazine comprising at least one receptacle for at least one of the knife blades and defining outsides, said magazine having at least one connecting element for fixedly engaging said handle, wherein means are provided for substantially entirely counter-sinking said magazine into said gripping portion, wherein said magazine provides on at least one of said outsides at least one locking member for positionally securing components of the handle, at least one of said outsides providing a part of the gripping portion of the handle when mounted.

41. The magazine according to claim 40, wherein said magazine has blocking surfaces for reciprocally locking the handle components, said blocking surfaces being formed by said outsides and providing slidable plug inserting guide faces for inserting said magazine into the handle, said guide faces being oriented transverse to said gripping portion.

42. A magazine for knife blades constructed to be entirely separably fixed to a gripping portion of a handle, said magazine comprising at least one receptacle for at least one of the knife blades and defining outsides, said magazine having at least one connecting element for fixedly engaging said handle, wherein means are provided for substantially entirely counter-sinking said magazine into said gripping portion, wherein said magazine has a bottom wall forming one of said outsides, said bottom wall having a wall outside provided with at least one projecting pin provided to engage in a reception of said handle.

43. A magazine for knife blades constructed to be entirely separably fixed to a gripping portion of a handle, said magazine comprising at least one receptacle for at least one of the knife blades and defining outsides, said magazine having at least one connecting element for fixedly engaging said handle, wherein means are provided for substantially entirely counter-sinking said magazine into said gripping portion, wherein said magazine has two facing end walls forming two outer sides of said outside, on said two outer sides being provided projecting cams, an external face being provided and connecting said two outer sides in a convexly curved manner.

44. A magazine for knife blades constructed to be entirely separably fixed to a gripping portion of a handle, said magazine comprising at least one receptacle for at least one of the knife blades and defining outsides, said magazine having at least one connecting element for fixedly engaging said handle, wherein means are provided for substantially entirely counter-sinking said magazine into said gripping portion, wherein said magazine provides a casing for receiving said knife blades, said casing defining an overall casing height extension and having two separate casing parts telescoping reciprocally over most of said casing height extension, each of said casing parts being cup-shaped and secured by at least one snap connection, each of said casing parts having a cup-shaped bottom defining a lateral passage opening for the knife blades.

45. The magazine according to claim 44, wherein at least one of said two casing parts provides at least one guide bevel for positively forcing the knife blades towards said passage opening.

46. The magazine according to claim 44, wherein said magazine has a height extension defining a height direction, said magazine having an intermediate bottom freely displaceable and insertable into said casing parallel to said height direction, said intermediate bottom having at least one of components provided by at least one spring tongue and at least one stop cam for the knife blades.

47. The holder according to claim 8, wherein at least two of said plurality of separate handle members displace relative to each other about a joint axis, said at least two of said plurality of separate handle members defining:

an area spaced from said locking means;

an area spaced from said joint axis;

an area in front of said joint axis toward said receptacle; and an area behind said joint axis away from said receptacle; said locking means securing said at least two of said plurality of handle members relative to each other by connecting to said at least two of said plurality of handle members in a direction transverse to at least one of:

said separation plane; and said blade plane.

48. The holder according to claim 5, wherein said handle has handle ends defining a front end and a rear end, said locking means being located at both of said handle ends.

49. The holder according to claim 47, wherein said locking means has a flank side located substantially in the vicinity of at least one of said separation plane and said blade plane, said locking means locking against stresses transverse to the separation plane by engagement of its flank side against an opposing handle member.

50. The holder according to claim 21, wherein said handle defines, between remote longitudinal ridges, varying overall handle height extensions and overall handle width extensions, bounded by said longitudinal ridges, said handle members being displaceable in a plane transverse to said overall handle width extensions, said handle providing a rear handle portion dimensioned to be circumferentially gripped by a single user hand and a frontal handle portion frontally connecting to said rear handle portion and providing a ball pressure face for a second hand of the user, wherein said rear handle portion traverses into said frontal handle portion by a steady increase of said overall handle width extensions, both said longitudinal ridges being equidirectionally curved substantially over said frontal handle portion.

51. The holder according to claim 50, wherein said handle has an overall longitudinal extension, a length center of said longitudinal extension and a front end, said longitudinal ridges passing continuously and smoothly over said rear handle portion and said frontal handle portion, said longitudinal ridges being substantially uniformly convexly curved substantially between said length center and said front end.

52. The holder according to claim 20, wherein said plug member includes a magazine for knife blades constructed to be entirely separably fixed to a gripping portion of the handle, said magazine comprising at least one receptacle for at least one of the knife blades and defining outside, said magazine having at least one connecting element for fixedly engaging said handle, wherein means are provided for entirely countersinking said magazine into said gripping position.

53. The holder according to claim 20, wherein said plug member includes a magazine for knife blades constructed to be entirely separably fixed to a gripping portion of the handle, said magazine comprising at least one receptacle for at least one of the knife blades and defining outside, said magazine having at least one connecting element for fixedly engaging said handle, wherein means are provided for entirely countersinking said magazine into said gripping position.

54. The holder according to claim 48, wherein said handle defines an overall height extension transverse to a longitudinal extension having a front end face and a rear end face, said locking means including locking structure spaced from the rear end face and extending substantially entirely along said shaft height extension.

* * * * *